United States Patent [19]

Smith

[11] 4,388,011

[45] Jun. 14, 1983

[54] MATERIAL DISPENSER TOOTHBRUSH

[76] Inventor: Donald R. Smith, 1601 Knoxville, Broken Arrow, Okla. 74012

[21] Appl. No.: 253,178

[22] Filed: Apr. 13, 1981

Related U.S. Application Data

[63] Continuation-in-part of Ser. No. 77,342, Sep. 20, 1979, Pat. No. 4,277,194.

[51] Int. Cl.[3] ..... A46B 11/02

[52] U.S. Cl. ..... 401/173; 401/287; 222/390; 132/84 R

[58] Field of Search ..... 222/390; 132/84 R; 401/172–175, 187

[56] References Cited

U.S. PATENT DOCUMENTS

| | | | |
|---|---|---|---|
| 910,970 | 1/1909 | Stryker | 222/390 |
| 936,101 | 10/1909 | Edwards | 222/390 |
| 953,373 | 3/1910 | Clark | 222/390 |
| 1,059,269 | 4/1913 | Boos | 222/390 |
| 1,581,277 | 4/1926 | McLaughlin | 222/390 |
| 1,780,066 | 10/1930 | Christian | 132/84 R |
| 2,058,290 | 10/1936 | Beaumont | 222/390 |
| 2,079,744 | 5/1937 | Macguire | 222/390 |
| 3,815,787 | 6/1974 | Spies | 222/390 |

FOREIGN PATENT DOCUMENTS

| | | | |
|---|---|---|---|
| 118846 | 8/1930 | Austria | 401/175 |
| 2225411 | 12/1973 | Fed. Rep. of Germany | 401/175 |
| 1028367 | 2/1953 | France | 401/175 |
| 463456 | 11/1968 | Switzerland | 401/175 |
| 1279839 | 6/1972 | United Kingdom | 401/172 |

*Primary Examiner*—Clyde I. Coughenour

*Attorney, Agent, or Firm*—Head, Johnson & Stevenson

[57] ABSTRACT

An apparatus for dispensing materials, such as toothpaste, stick deodorant, lipstick and the like, comprising a hollow handle for containing material, a dispenser drive member reciprocally disposed in the handle and at least one rotatable operator provided at one end of the handle and operably connected to the drive member for longitudinally moving the drive member within the handle in order to force the material therein out of the opposite end. Also a disposable, collapsible paste material cartridge for containing material to be dispensed within the handle and cooperating with the drive member.

8 Claims, 7 Drawing Figures

MATERIAL DISPENSER TOOTHBRUSH

CROSS-REFERENCE TO RELATED APPLICATION

This is a continuation-in-part application of my co-pending U.S. application Ser. No. 77,342, filed Sept. 20, 1979 for a "Paste Dispensing Toothbrush", now U.S. Pat. No. 4,277,194 issued July 7, 1981.

BACKGROUND OF THE INVENTION

1. Field of the Invention

The present invention relates to a paste and solid material dispenser and more particularly, but not by way of limitation, to a mechanical apparatus for the dispensing of toiletry and cosmetic materials, such as toothpaste, deodorant and the like.

2. History of the Prior Art

There has been a long-felt need to provide a handy toiletry dispensing apparatus which can dispense such items as toothpaste, lipstick, stick deodorant and the like.

Many attempts have been made to provide toothbrushes which carry their own supply of toothpaste in the handle or in a compartment associated with the toothbrush primarily for the purposes of portability to obviate the need of carrying a toothbrush and separately carrying a tube of toothpaste. Until the disclosure of my co-pending application, there had been little success in providing such an apparatus that is simple and economical in construction and yet effective in getting the job done. However, even with the apparatus of my co-pending application, after a cartridge of toothpaste has been expelled, it would be necessary to rotate the operator member in order to withdraw the drive member to accept a new cartridge.

Other dispensers of toiletry and cosmetic products, such as stick deodorant and lipstick, while being reasonably effective, are wasteful in that the dispenser which moves the product out of the container is typically discarded after the container is empty. These devices usually have a cranking mechanism at one end thereof coupled with either a threaded rod or other mechanical device to move the product out the opposite end. Even though these dispensing devices are relatively unsophisticated, the discarding of the container after it is empty is both wasteful from a natural resource standpoint and it significantly adds to the cost of the material being dispensed, all of which must ultimately be borne by the consumer.

SUMMARY OF THE INVENTION

The present invention provides a material dispensing apparatus which is reusable, simple and effective in operation and is designed to overcome the above-identified disadvantages.

The dispenser primarily comprises a hollow handle member having internal threading over a portion of the length thereof. An elongated sleeve member is rotatably disposed within the handle member for containing a preloaded cartridge of toothpaste, stick deodorant, lipstick or other toiletry product. A rotary drive member is carried by the sleeve member and engaged with the internal threading of the handle member. Each end of the sleeve member is provided with an operator/dispenser nozzle whereby rotation of this operator/dispenser nozzle causes the drive mechanism to move toward the opposite end of the tube which will dispense the product located therein.

After the product has been totally dispensed, a new product is simply loaded into the opposite end of the device and the second operator dispenser mechanism may be rotated in order to move the drive member toward the opposite end of the handle member.

In this manner, the device is quite easily usable as a toothpaste dispenser by simply having a toothbrush mechanism that will attach to either end of the handle. The device is further readily usable with stick deodorant, lipstick or other toiletry material, without incurring the wastefulness of disposing of the entire mechanism after it has been used. In fact, the present device may be used over and over again and hence, would warrant being constructed from a more durable material, such as high-impact plastic or even metal.

In the use of paste material, two embodiments of a collapsible cartridge are taught herein which would be very adept at handling toothpaste or other paste products. The first embodiment relates to a cartridge made of a plurality of flexible bevel units formed in an accordion style which may be easily collapsed by the drive mechanism while forcing the material out of the end of the apparatus. The second embodiment relates to a telescoping cartridge which may be made of very inexpensive plastic material.

DESCRIPTION OF THE DRAWINGS

Other and further advantageous features of the present invention will hereinafter more fully appear in connection with a detailed description of the drawings in which.

DESCRIPTION OF THE PREFERRED EMBODIMENTS

Figure 1:
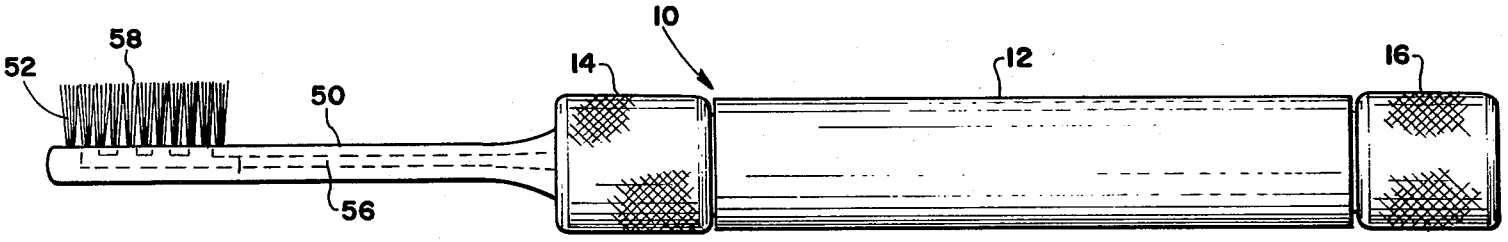
FIG. 1 is a side elevational view of a dispensing apparatus embodying the present invention and having a toothbrush attached at one end thereof.

Referring to the drawings in detail, reference character 10 generally indicates a material dispensing apparatus comprising an elongated hollow handle member 12 and a pair of oppositely disposed operator nozzle members 14 and 16 rotatably carried at each end of the handle member 12. A portion of the interior of said handle member is provided with internal threading 17.

An elongated cylindrical sleeve member 18 is rotatably carried within the handle member 12 by means of sealing or rotating rings 20 and 22 at each end thereof. These rings 20 and 22 may be in the form of bearings, sleeve inserts or the like. The outer ends of the sleeve member 18 are provided with threaded portions 24 and 26 which extend outwardly of the handle member 12 at each end thereof. A pair of elongated longitudinal slots 28 and 30 are provided on opposite sides of the sleeve member 18.

An elongated plate member 32 having rectangular cross-section is slidably disposed within the slots 28 and 30. Each end of the plate member 32 is provided with threads at 34 and 36 for threadedly meshing with the internal threading 17 of the handle member. The plate member 32 will be hereinafter referred to as a dispenser device member. The interior of the handle member is provided with gaps in the threading at 38 and 40 at each end thereof for a purpose that will be hereinafter set forth.

The operator member 14 comprises a cylindrical roller member having threads at 42 for attachment to the threaded end 24 of the sleeve member 18. The outer end of the collar member 13 is likewise provided with a plurality of internal threads at 44 for a purpose that will be hereinafter set forth.

The operator member 16 also constitutes a collar member provided with internal threading 46 at the inner end thereof and internal threading 48 at the outer end thereof leaving a passageway therethrough.

When the device 10 serves as a toothpaste dispenser, an elongated toothbrush shank member 50 is provided. The toothbrush shank member 50 has bristles 52 at one end thereof and a threaded coupling portion 54 at the opposite end thereof which is matable with either the threads 44 of the operator member 14 or the threads 48 of the operator member 16. The shank 50 of the toothbrush is also provided with an elongated passageway 56 therethrough having ports 58 for allowing paste traveling through said passageway to enter into contact with the bristles 52. The inner end of the shank member is provided with a cylindrical knife edge cutter 60 for a purpose that will be hereinafter set forth.

Figure 3:
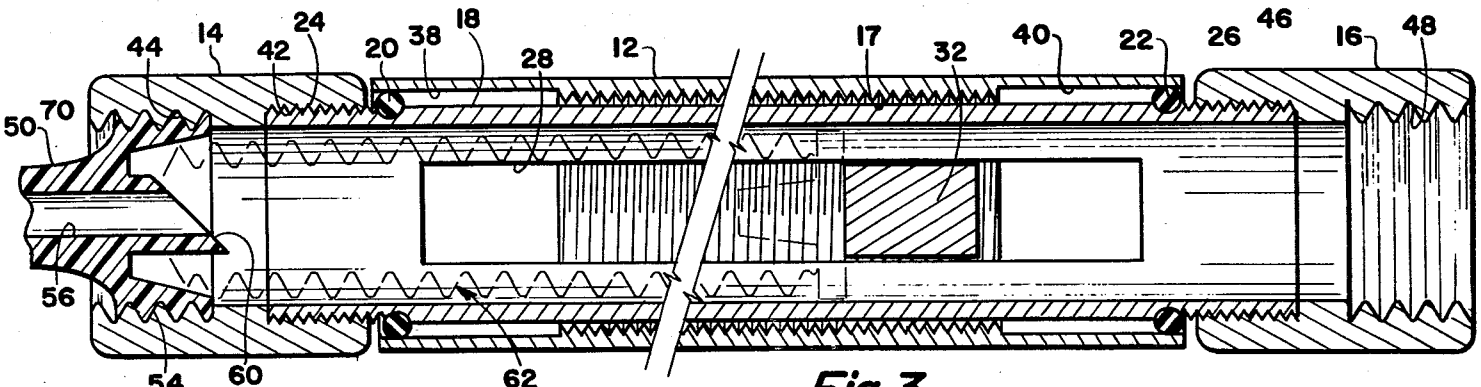
FIG. 3 is a side elevational view of the device of FIG. 2 depicting the cartridge in a partially collapsed condition.
Figure 2:
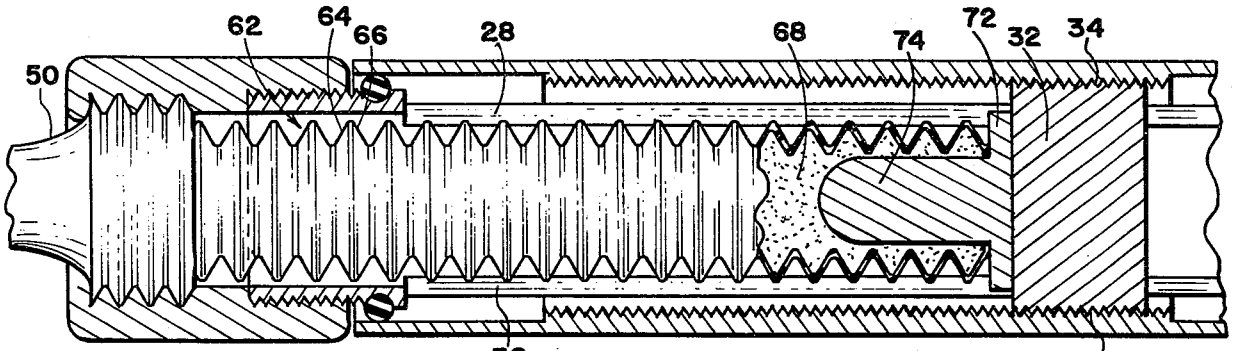
FIG. 2 is a side elevational sectional view of the device of FIG. 1 depicting a first embodiment of a collapsible toothpaste container or cartridge therein.
Figure 4:
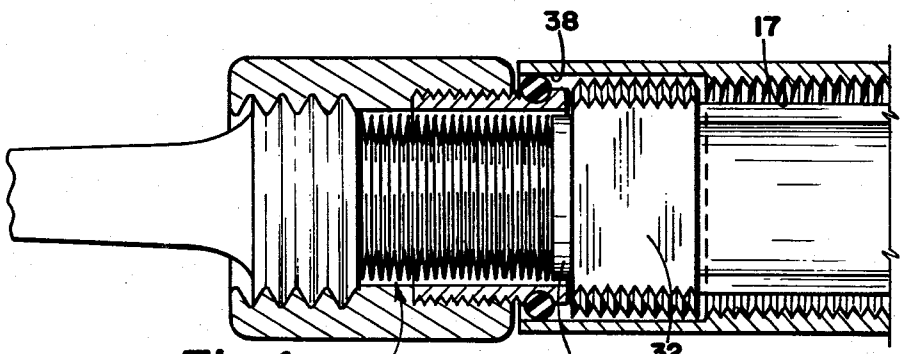
FIG. 4 is a partial side elevational view of the device of FIG. 3 wherein the cartridge is totally collapsed.
Figure 6:
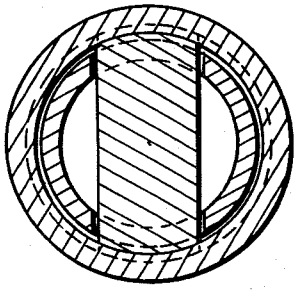
FIG. 6 is an end elevational sectional view taken along the broken lines 6—6 of FIG. 5.

Referring to FIGS. 2, 3 and 4 of the drawings, reference character 62 generally indicates a collapsible toothpaste or general paste dispenser cartridge which comprises a plurality of oppositely facing bevel members 64 and 66 which are made of a flexible material such as plastic and are arranged in an accordion fashion for containing a paste 68 therein. One end of the cartridge 62 is provided with a sealing membrane 70 thereacross, the opposite end being sealed by a plate member 72 having an inwardly extending mandrel 74 secured thereto or made as a part thereof.

In operation, the toothbrush shank 50 is removed from the dispensing apparatus and the loaded cartridge 62 is inserted therein with the plate member 72 being disposed in contact with the dispensing drive member 32.

The toothbrush shank member 50 then, by means of its threads 54, is threadedly attached to the coupling member 14 and screwed all the way down so that the knife edge portion 60 thereof pierces the sealing membrane 70 of the cartridge 62. This, therefore, opens the interior of the cartridge 62 to the passageway 56 of the toothbrush shank member.

The operator member 16 may then be rotated thereby causing the sleeve member 18 to be rotated therewith. Rotation of the sleeve member 18 causes the drive dispenser member 32 to threadedly move along the internal threading 17 of the handle member thereby causing the cartridge to start collapsing which forces paste out the open end thereof into the passageway 56 of the toothbrush shank member ultimately applying paste to the bristles 58 thereof.

After use of the toothbrush, the bristles 58 may simply be washed out or if it is desired to clean the entire toothbrush mechanism, it may be temporarily removed so that the passageway 56 may also be cleaned out. This operation is continued from day to day with each use of the toothbrush until the cartridge is fully expended and in a collapsed position as shown in FIG. 4. At this point it is noted that when the cartridge 62 is collapsed it still has a certain length which would typically be filled with paste that is not dispensed. However, when in a collapsed position as shown in FIG. 4, the mandrel 74 will extend through the collapsed cartridge thereby forcing most of the paste out into the toothbrush shank.

It is also noted in FIG. 4 that the drive member 32 has moved into the unthreaded segment 38 or out of contact with the internal threading 17 of the handle member. Therefore, further rotation of the handle will simply cause the drive member 32 to rotate within the unthreaded segment 38 in order to prevent driving the cartridge and collar member beyond their designated point of travel.

In order to reload the toothbrush handle, the collar member 16 is removed and a new cartridge 62 is inserted in the opposite end of the handle member. The toothbrush shank member 50 then is inserted into the collar member 16 and the collar member 14 now becomes the operator member in order to drive the dispenser drive member 32 back toward the opposite end of the handle in order to further dispense toothpaste from the new cartridge.

Figure 5:
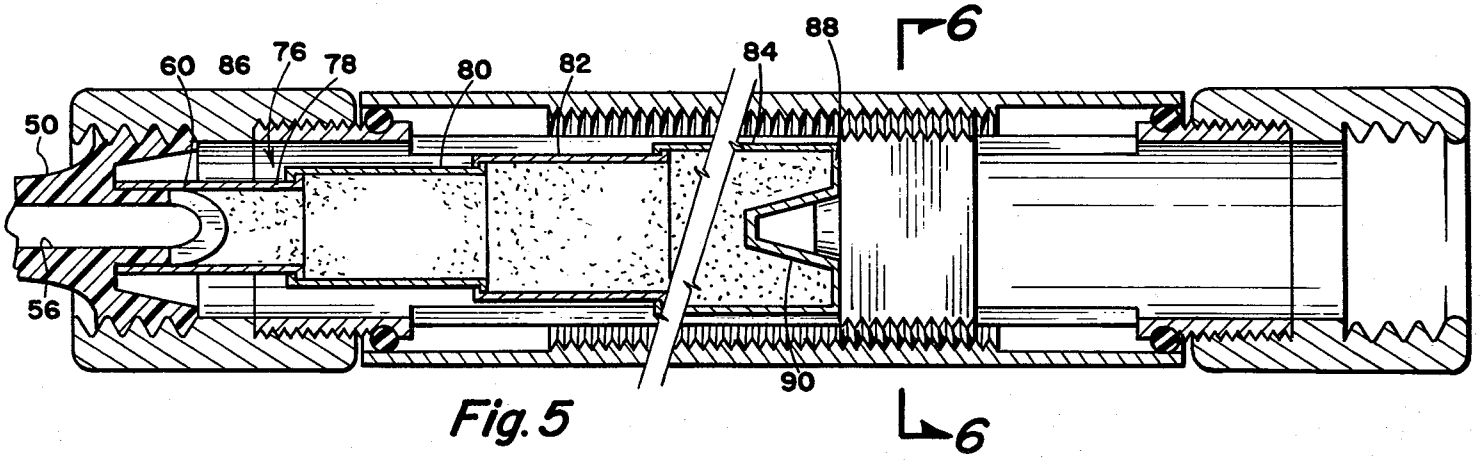
FIG. 5 is a side elevational sectional view of the device of FIG. 1 depicting a second embodiment of a collapsible cartridge therein.

Referring now to FIG. 5 of the drawings, reference character 76 generally indicates a second embodiment of the collapsible cartridge comprising a plurality of telescoping sleeve members 78, 80, 82 and 84 for containing paste material therein. One end of the cartridge is provided with a sealing membrane 86 of plastic material that may be severed by the cutting edge 60 of the toothbrush holder 50. The opposite end of the cartridge is closed off by means of a plate member 88 having an inwardly extending mandrel 90 therein which serves to more completely expel the paste when the telescoping cartridge 76 is in its collapsed position.

In operation the telescopic cartridge 76 is used in a similar manner to the telescoping cartridge 62 hereinbefore described.

Figure 7:
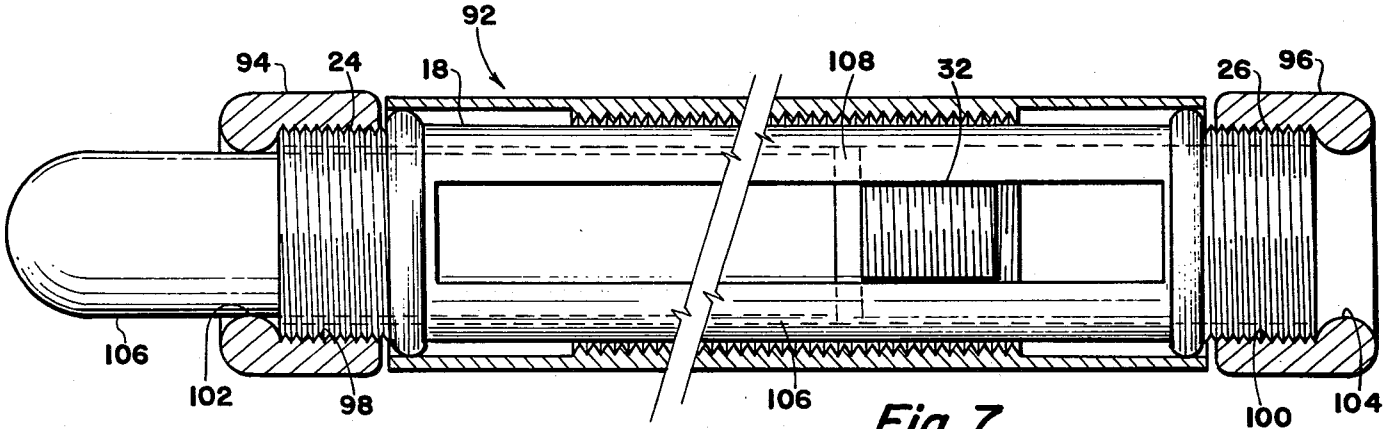
FIG. 7 is a side elevational view of the device of FIG. 1 depicting a stick material, such as deodorant or lipstick, contained therein.

Referring now to FIG. 7 of the drawings, reference character 92 generally indicates an embodiment of the dispenser apparatus wherein the handle, internal sleeve member and drive member are identical to that of the dispenser 10 hereinbefore described. However, the dispenser of FIG. 7 is for dispensing solid stick materials, such as deodorant, lipstick and the like. Instead of utilizing the collars 14 and 18 hereinbefore described for carrying a toothbrush member, collars 94 and 96 may be utilized which are attachable directly to the outer threading 24 and 26, respectively, of sleeve member 18. The collar members 94 and 96 are provided with internal threading 98 and 100, respectively, leaving apertures 102 and 104, respectively, at the outer ends thereof.

A stick of material to be dispensed, such as deodorant or lipstick, is indicated by reference character 106 and is provided with an end plate member 108 attached thereto for engagement with the dispenser drive member 32.

The dispenser 92 works in essentially the same way as the toothpaste dispenser in that rotation of the collar member 96 will cause the dispenser drive member 32 to push against the end plate member 108 thereby forcing the stick material 106 to exit the opposite collar member 94.

From the foregoing it is apparent that the present invention provides a mechanical dispensing apparatus which is useful in dispensing both paste and solid products. It is understood that within the scope of the invention, other products not in the toiletry classification may be dispensed using this device. In other words, in place of the toothbrush shown in the drawings, a nozzle might be included for dispensing glue or other paste-type products, including food products. The device may also be utilized to dispense solid products, such as solid lubricant material by utilizing the embodiment shown in FIG. 7.

Whereas the present invention has been described in particular relation to the drawings attached hereto, other and further modifications apart from those shown or suggested herein may be made within the spirit and scope of the invention.

What is claimed is:

1. A material dispenser apparatus comprising an elongated cylindrical hollow handle, a central portion thereof being internally threaded, an elongated sleeve member disposed with in the handle for carrying material to be dispensed and independently rotatable with respect to the handle, a pair of oppositely disposed longitudinal slots provided in said sleeve member, a dispenser drive member transversely disposed through said slots and having outer threaded ends in cooperative engagement with the internal threading of the handle, operator means at a first end of the handle operably connected to the sleeve member to impart said independent rotation of said sleeve member thereby causing the drive member to rotate and translate along said longitudinal slots for forcing material out of the opposite end thereof, and including a second operator means at a second opposite end of the handle which is operably connected to the sleeve member to impart said independent rotation thereto, each said operator means being provided with a longitudinal aperture for permitting selective dispensing of material through either end of the sleeve, and in combination with a disposable collapsible cartridge for carrying paste material to be dispensed, said cartridge being disposed within the sleeve member, a first end thereof being in contact with the dispenser drive member, a second opposite end thereof being provided with an opening alignable with the aperture of the second operator means.

2. A dispenser apparatus as set forth in claim 1 wherein the internal threading of the handle extends throughout the central portion thereof leaving an unthreaded segment at each end of the handle, each said unthreaded segment being of a length substantially equal to the width of the threaded end of the drive member whereby when said drive member is moved into the unthreaded segment, further turning of the handle operator produces no further longitudinal movement of the drive member.

3. A dispenser apparatus as set forth in claim 1 in combination with a disposable collapsible cartridge for carrying paste material to be dispensed, said cartridge being disposed within the sleeve member, a first end thereof being in contact with the dispenser drive member, a second opposite end thereof being provided with an opening alignable with the aperture of the second operator means.

4. A dispenser apparatus as set forth in claim 1 wherein the cartridge is provided with a sealing membrane across the opening and including means to puncture said membrane after it is installed within the sleeve.

5. A dispenser apparatus as set forth in claim 3 wherein the cartridge is of an accordion construction.

6. A dispenser apparatus as set forth in claim 5 wherein the paste material is toothpaste.

7. A dispenser apparatus as set forth in claim 5 and including a mandrel segment provided in the first end of the cartridge for forcing the remaining material out of the cartridge upon collapse thereof.

8. A dispenser apparatus as set forth in claim 1 wherein the sleeve member is provided with an outwardly extending threaded end portion, each said operator means being attachable thereto.

* * * * *